US010474077B1

(12) United States Patent
Saito

(10) Patent No.: US 10,474,077 B1
(45) Date of Patent: Nov. 12, 2019

(54) FIXING DEVICE AND IMAGE FORMING APPARATUS HAVING CONTACTING UNIT

(71) Applicant: FUJI XEROX CO., LTD., Tokyo (JP)

(72) Inventor: Yuichiro Saito, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/175,849

(22) Filed: Oct. 31, 2018

(30) Foreign Application Priority Data

May 17, 2018 (JP) ..... 2018-094994

(51) Int. Cl.
*G03G 15/20* (2006.01)
*G03G 15/00* (2006.01)

(52) U.S. Cl.
CPC ..... *G03G 15/2064* (2013.01); *G03G 15/2028* (2013.01); *G03G 15/2039* (2013.01); *G03G 15/6511* (2013.01)

(58) Field of Classification Search
CPC ..... G03G 15/2017; G03G 15/2039
USPC ..... 399/33, 69, 328, 329
See application file for complete search history.

(56) References Cited

U.S. PATENT DOCUMENTS 5,937,231 A * 8/1999 Aslam et al. ..... G03G 15/2039 399/328
8,385,755 B2 * 2/2013 Hyun et al. ..... G03G 15/2039 399/33
9,632,463 B2 * 4/2017 Yagi et al. ..... G03G 15/2039
2005/0089343 A1 * 4/2005 Mathers ..... G03G 15/205 399/69

FOREIGN PATENT DOCUMENTS

JP 2012027168 2/2012

* cited by examiner

*Primary Examiner* — William J Royer
(74) *Attorney, Agent, or Firm* — JCIPRNET

(57) ABSTRACT

A fixing device includes a heating unit that is rotatable and includes a heat source; a pressing unit that is rotatable and forms a nip together with the heating unit; and a contact unit capable of coming into contact with and moving away from the heating unit. The contact unit is positioned so that the contact unit does not overlap a region above the heating unit in a vertical direction when the contact unit is in contact with the heating unit and also does not overlap the region above the heating unit in the vertical direction when the contact unit is separated from the heating unit.

11 Claims, 9 Drawing Sheets

FIXING DEVICE AND IMAGE FORMING APPARATUS HAVING CONTACTING UNIT

CROSS-REFERENCE TO RELATED APPLICATIONS

This application is based on and claims priority under 35 USC 119 from Japanese Patent Application No. 2018-094994 filed May 17, 2018.

BACKGROUND

(i) Technical Field

The present disclosure relates to a fixing device and an image forming apparatus.

(ii) Related Art

Japanese Unexamined Patent Application Publication No. 2012-27168 describes a fixing device including a fixing member, a pressing member, a cooling member, detecting means, and a moving member. The fixing member rotates and heats a developer image on a recording medium to fix the developer image to the recording medium. The pressing member presses the recording medium between itself and the fixing member. The cooling member is capable of coming into contact with and moving away from the outer peripheral surface of the fixing member, and comes into contact with the outer peripheral surface of the fixing member to reduce the temperature of the fixing member. The detecting means is disposed on a transport path of the recording medium and detects the recording medium. A contact position at which the leading end of the recording medium comes into contact with the outer peripheral surface of the fixing member is determined based on a detection result obtained by the detecting means. The moving member allows the cooling member to be in contact with the fixing member until the contact position between the leading end of the recording medium and the fixing member reaches a contact position between the cooling member and the fixing member, and moves the cooling member away from the fixing member when the contact position between the leading end of the recording medium and the fixing member reaches the contact position between the cooling member and the fixing member.

SUMMARY

Aspects of non-limiting embodiments of the present disclosure relate to a fixing device and an image forming apparatus in which an excessive temperature increase of a contact means is less than that in a configuration in which the contact means is disposed vertically above heating means.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including a heating unit that is rotatable and includes a heat source; a pressing unit that is rotatable and forms a nip together with the heating unit; and a contact unit capable of coming into contact with and moving away from the heating unit. The contact unit is positioned so that the contact unit does not overlap a region above the heating unit in a vertical direction when the contact unit is in contact with the heating unit and also does not overlap the region above the heating unit in the vertical direction when the contact unit is separated from the heating unit.

BRIEF DESCRIPTION OF THE DRAWINGS

An exemplary embodiment of the present disclosure will be described in detail based on the following figures, wherein.

DETAILED DESCRIPTION

Figure 1:
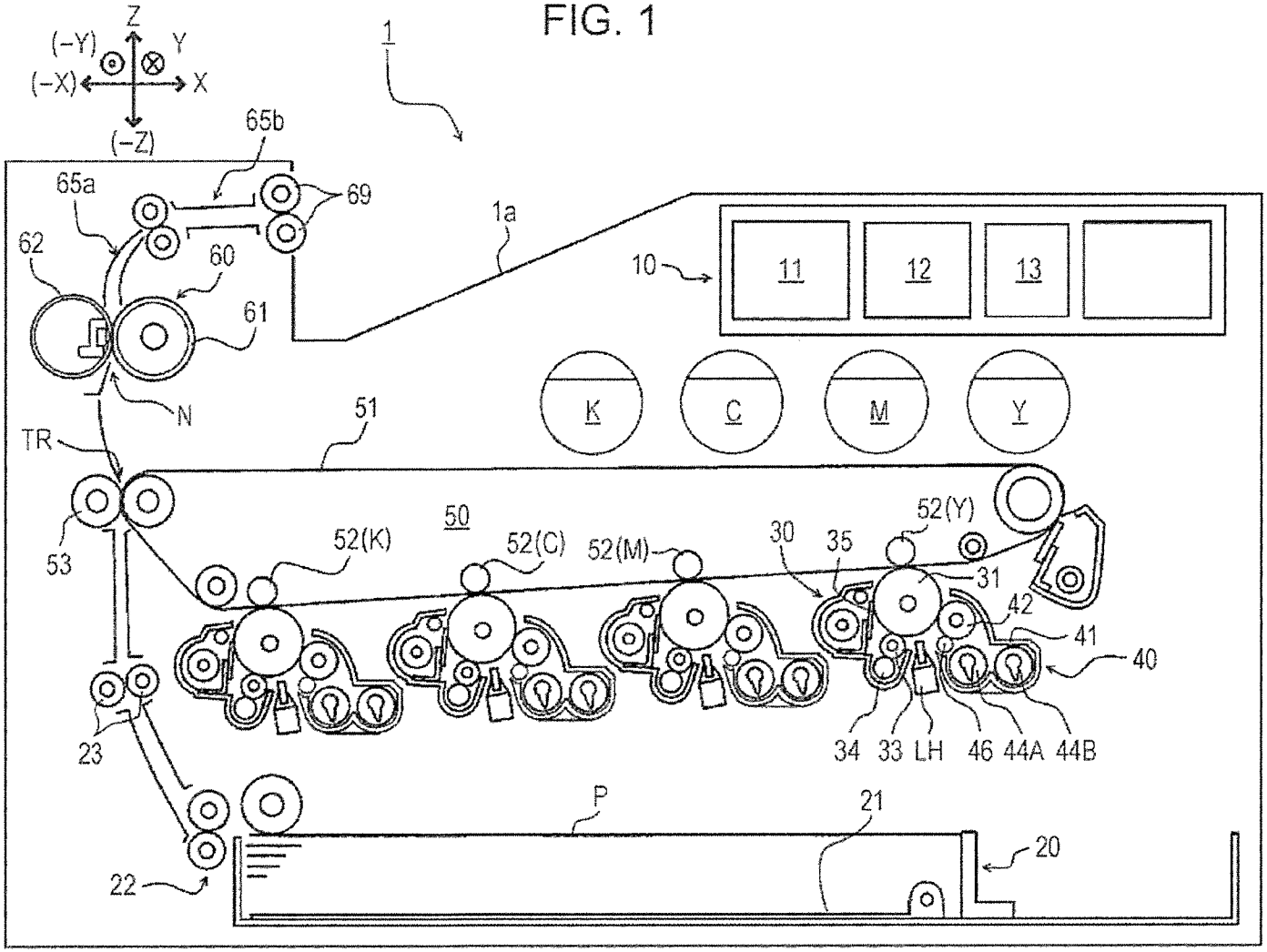
FIG. 1 is a schematic sectional view illustrating the internal structure of an image forming apparatus.

The present disclosure will be described in further detail by way of an exemplary embodiment and examples with reference to the drawings. However, the present disclosure is not limited to the exemplary embodiment and examples.

It is to be noted that the drawings referred to in the following description are schematic, and that dimensional ratios, for example, in the drawings differ from the actual dimensional ratios. Components other than those necessary to be described to facilitate understanding are omitted as appropriate in the drawings.

To facilitate understanding of the following description, in the drawings, the front-rear direction is defined as the X-axis direction, the left-right direction is defined as the Y-axis direction, and the vertical direction is defined as the Z-axis direction.

(1) Overall Structure and Operation of Image Forming Apparatus

FIG. 1 is a schematic sectional view illustrating the internal structure of an image forming apparatus 1 according to the present exemplary embodiment.

The overall structure and operation of the image forming apparatus 1 will be described with reference to FIG. 1.

The image forming apparatus 1 includes a control device 10, a sheet feeding device 20, photoconductor units 30, developing devices 40, a transfer device 50, and a fixing device 60. An output tray 1*a*, which receives paper sheets having images recorded thereon, is provided on the top surface (surface facing in the Z direction) of the image forming apparatus 1.

The control device 10 includes a controller 11 that controls the operation of the image forming apparatus 1, and also includes an image processing unit 12 and a power supply device 13 controlled by the controller 11. The power supply device 13 applies a voltage to, for example, charging rollers 33, developing rollers 42, first transfer rollers 52 (52(K), 52(C), 52(M), 52(Y)), and a second transfer roller 53, which will be described below.

The image processing unit 12 converts print information received from an external information transmission device (for example, a personal computer) into image information used to form latent images, and outputs driving signals to exposure heads LH at a preset timing. Each of the exposure heads LH according to the present exemplary embodiment includes a light emitting diode (LED) head in which a plurality of LEDs are linearly arranged.

The sheet feeding device 20 is disposed at the bottom of the image forming apparatus 1. The sheet feeding device 20 includes a sheet tray 21. Multiple paper sheets P, which serve as recording media, are stacked on the sheet tray 21. The paper sheets P, which are stacked on the sheet tray 21 and positioned in a width direction and a length direction by alignment plates (not shown), are fed forward (in the −X direction) one at a time from the top by a sheet-feeding unit 22, and then transported to a nip portion of a registration roller pair 23.

The photoconductor units 30 are arranged next to each other above (on the Z direction side of) the sheet feeding device 20, and each includes a photoconductor drum 31, which rotates and serves as a toner image carrier. The charging roller 33, the exposure head LH, the developing device 40, the first transfer roller 52, and a cleaning blade 35 are arranged around each photoconductor drum 31 in the rotation direction of the photoconductor drum 31. A cleaning roller 34 that cleans the surface of the charging roller 33 is arranged to face and contact the charging roller 33.

Each developing device 40 includes a developing housing 41 that contains developer. The developing housing 41 houses the developing roller 42, which serves as developing means and opposes the photoconductor drum 31, and a pair of augers 44A and 443 that are disposed behind and below the developing roller 42 and that transport the developer toward the developing roller 42 while stirring the developer. A layer-thickness regulating member 46, which regulates the layer thickness of the developer, is disposed near the developing roller 42.

The developing devices 40 have substantially the same structure except for the developers contained in the developing housings 41 thereof, and form yellow (Y), magenta (M), cyan (C), and black (K) toner images.

The surface of each photoconductor drum 31 that rotates is charged by the charging roller 33, and an electrostatic latent image is formed thereon by latent-image-forming light emitted from the exposure head LH. The electrostatic latent image formed on the photoconductor drum 31 is developed into a toner image by the developing roller 42, which serves as developing means.

The transfer device 50 includes an intermediate transfer belt 51, which serves as an intermediate transfer body, the first transfer rollers 52, which serve as first transfer means, and the second transfer roller 53, which serves as second transfer means. The toner images of the respective colors formed on the photoconductor drums 31 of the photoconductor units 30 are transferred onto the intermediate transfer belt 51 in a superposed manner. The first transfer rollers 52 successively transfer the toner images of the respective colors formed by the photoconductor units 30 onto the intermediate transfer belt 51 (first transfer process). The second transfer roller 53 simultaneously transfers the toner images of the respective colors that have been transferred onto the intermediate transfer belt 51 in a superposed manner onto a paper sheet P, which serves as a recording medium (second transfer process).

The toner images of the respective colors formed on the photoconductor drums 31 of the photoconductor units 30 are successively electrostatically transferred onto the intermediate transfer belt 51 by the first transfer rollers 52, which receive a predetermined transfer voltage from, for example, the power supply device 13 controlled by the controller 11 (first transfer process). Thus, a superposed toner image in which the toner images of the respective colors are superposed is formed.

The superposed toner image on the intermediate transfer belt 51 is transported toward a region in which the second transfer roller 53 is located (second transfer region TR) as the intermediate transfer belt 51 is moved. The paper sheet P is supplied to the second transfer region TR from the sheet feeding device 20 in accordance with the timing at which the superposed toner image is transported to the second transfer region TR. The second transfer roller 53 receives a predetermined transfer voltage from, for example, the power supply device 13 controlled by the controller 11, so that the superposed toner image on the intermediate transfer belt 51 is transferred onto the paper sheet P that has been fed from the registration roller pair 23 and guided by a transport guide.

The residual toner on the surface of each photoconductor drum 31 is removed by the cleaning blade 35 and collected in a waste toner container (not shown). The surface of the photoconductor drum 31 is charged again by the charging roller 33. The residual substances that have not been removed by the cleaning blade 35 and that have adhered to the charging roller 33 are transferred to the surface of the cleaning roller 34 that rotates while being in contact with the charging roller 33 and are accumulated.

The fixing device 60 includes a heating module 61 and a pressing module 62, and a fixing nip portion N (fixing region) is formed in the region where the heating module 61 and the pressing module 62 are pressed against each other.

The paper sheet P onto which the toner image has been transferred by the transfer device 50 is transported to the fixing device 60 along the transport guide while the toner image is not fixed. The paper sheet P transported to the fixing device 60 is heated and pressed by the heating module 61 and the pressing module 62, so that the toner image is fixed thereto. The paper sheet P on which the fixed toner image is formed is guided by transport guides 65*a* and 65*b* and discharged to the output tray 1*a* on the top surface of the image forming apparatus 1 from a pair of transport rollers 69.

Thus, the image forming apparatus 1 includes a C-shaped transport path along which the paper sheet P is transported from the sheet feeding device 20 to the transport rollers 69 via the second transfer roller 53. Thus, the length of the transport path that transports the paper sheet P is minimized, and the first print out time (FPOT), which is a time period from when printing is started to when the first paper sheet P is discharged, is minimized accordingly.

(2) Fixing Device

Figure 2:
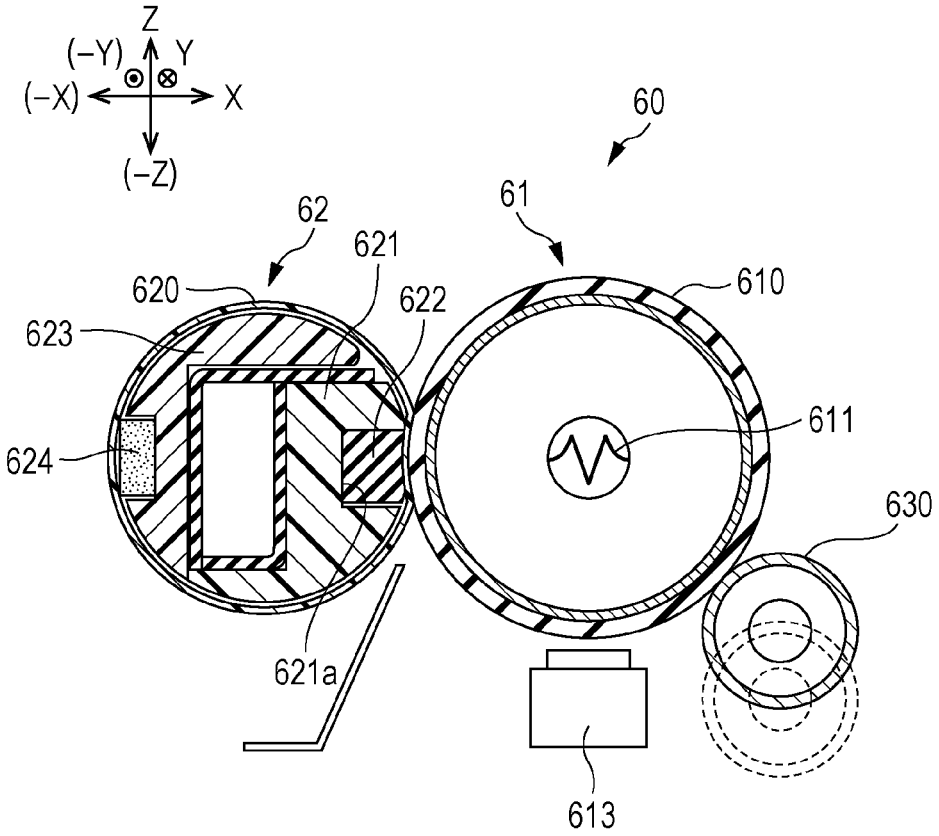
FIG. 2 is a schematic sectional view illustrating the structure of a fixing device.

FIG. 2 is a schematic sectional view illustrating the structure of the fixing device 60.

The fixing device 60 includes the heating module 61, the pressing module 62, a heat absorbing roller 630, and a retraction mechanism (not shown). The heating module 61 includes a heating roller 610 as an example of heating means or heating unit. The pressing module 62 includes a pressing belt 620 as an example of pressing means or pressing unit. The heat absorbing roller 630 is an example of contact means or contact unit that reduces the temperature of the outer peripheral surface of the heating roller 610 by coming into contact therewith. The retraction mechanism moves the heat absorbing roller 630 so that the heat absorbing roller 630 comes into contact with or moves away from the heating roller 610.

(2.1) Heating Module

The heating module 61 includes the heating roller 610, a fixing lamp 611, and a gear (not shown). The heating roller 610, which serves as a heating rotator, comes into contact with and heats the paper sheet P that passes through the fixing nip portion N. The fixing lamp 611, which serves as a heating source, is disposed in the heating roller 610 with a gap between the fixing lamp 611 and the inner peripheral surface of the heating roller 610. The gear receives a rotational driving force from a driving unit (not shown) of the image forming apparatus 1 and rotates the heating roller 610.

The heating roller 610 is a cylindrical member having open ends, and has a multilayer structure in which an elastic layer made of silicone rubber and a release layer containing fluorine resin are provided on an outer peripheral surface of a thin-walled metal pipe that serves as a base material.

A thermistor (not shown) and a thermostat 613, each of which is an example of a temperature detector, are arranged around the heating roller 610. The thermistor detects the surface temperature of the heating roller 610. The thermostat 613 cuts off the supply of electricity to the fixing lamp 611 when an abnormal temperature increase of the heating roller 610 is detected.

(2.2) Pressing Module

The pressing module 62 includes the pressing belt 620 that serves as an endless belt and a pressing member 621. The pressing member 621 presses and supports the pressing belt 620 at the inner peripheral surface of the pressing belt 620, so that the fixing nip portion N is formed between contact portions of the pressing belt 620 and the heating roller 610.

The pressing member 621 is disposed on the inner peripheral surface of the pressing belt 620 and presses the pressing belt 620 so that the outer peripheral surface of the pressing belt 620 is pressed against the outer peripheral surface of the heating roller 610. The pressing member 621 has a recess 621*a* that opens toward the fixing nip portion N and to which a pad member 622 made of silicone rubber is fixed.

The pressing member 621 is made of a heat-resistant synthetic resin, such as polyethylene terephthalate (PET) or liquid crystal polymer (LCP).

The pressing belt 620 is an endless belt member having open ends, and has a multilayer structure obtained by forming a release layer containing fluorine resin, such as polytetrafluoroethylene (PTFE), on a surface of a belt base material made of a heat-resistant resin, such as polyimide (PI), and having a thin-walled cylindrical shape.

A retaining member 623 made of a heat-resistant synthetic resin is disposed on the inner peripheral surface of the pressing belt 620. The retaining member 623 has an opening that faces the heating roller 610, and retains the pressing belt 620 at the inner peripheral surface of the pressing belt 620 in a region outside the fixing nip portion N. A plurality of ribs (not shown) that extend in the rotation direction of the pressing belt 620 are provided on the outer peripheral surface of the retaining member 623, which faces the inner peripheral surface of the pressing belt 620, to suppress an increase in rotational resistance due to contact between the retaining member 623 and the pressing belt 620.

A sliding sheet (not shown), which is a film member that enables sliding of the pressing belt 620, is disposed between the inner peripheral surface of the pressing belt 620 and each of the pressing member 621 and the pad member 622 in the fixing nip portion N. The sliding sheet is formed of, for example, a thin sheet member containing highly heat-resistant fluorine resin having a low coefficient of friction, such as polytetrafluoroethylene (PTFE).

A felt member 624 is disposed between the retaining member 623 and the inner peripheral surface of the pressing belt 620. The felt member 624 is impregnated with lubricating silicone oil. The felt member 624 is in contact with the inner peripheral surface of the pressing belt 620 and supplies the silicone oil to the inner peripheral surface of the pressing belt 620 to suppress an increase in the rotational resistance of the pressing belt 620.

(2.3) Heat Absorbing Roller

The heat absorbing roller 630, which is an example of contact means, is constituted by, for example, a cylindrical aluminum tube having a blasted surface. The heat absorbing roller 630 is disposed upstream of the thermistor and the thermostat 613 in the rotation direction of the heating roller 610. The heat absorbing roller 630 is brought into contact with or moved away from the outer peripheral surface of the heating roller 610 in response to the operation of the retraction mechanism. When the heat absorbing roller 630 is not used, the heat absorbing roller 630 is separated from the outer peripheral surface of the heating roller 610.

During the operation of the image forming apparatus 1 in which the heating module 61 of the fixing device 60 is heated, the heat absorbing roller 630 is brought into contact with the outer peripheral surface of the heating roller 610 and rotated by an amount corresponding to a single revolution of the heating roller 610 when the temperature of the heating roller 610 exceeds a set temperature. Thus, the temperature variation of the heating roller 610 in the circumferential direction is reduced.

For example, when the paper sheet P enters the fixing nip portion N, the outer peripheral surface of the heating roller 610 is reduced in temperature in the region in which the paper sheet P has come into contact therewith because heat is consumed when the toner image is fixed and is also absorbed by the paper sheet P. Accordingly, the temperature of the heating roller 610 varies in the circumferential direction and there is a risk that the fixed image will have non-uniform brightness. To prevent this, the heat absorbing roller 630 is rotated in contact with the outer peripheral surface of the heating roller 610 by an amount corresponding to a single revolution of the heating roller 610 to absorb heat. As a result, the temperature variation of the heating roller 610 in the circumferential direction is reduced, and the risk that the fixed toner image will have non-uniform brightness is reduced accordingly. The heat absorbing roller 630 is separated from the outer peripheral surface of the heating roller 610 after being rotated in contact therewith by an amount corresponding to a single revolution of the heating roller 610.

(2.4) Arrangement of Heat Absorbing Roller, Thermistor, and Thermostat

Figure 3:
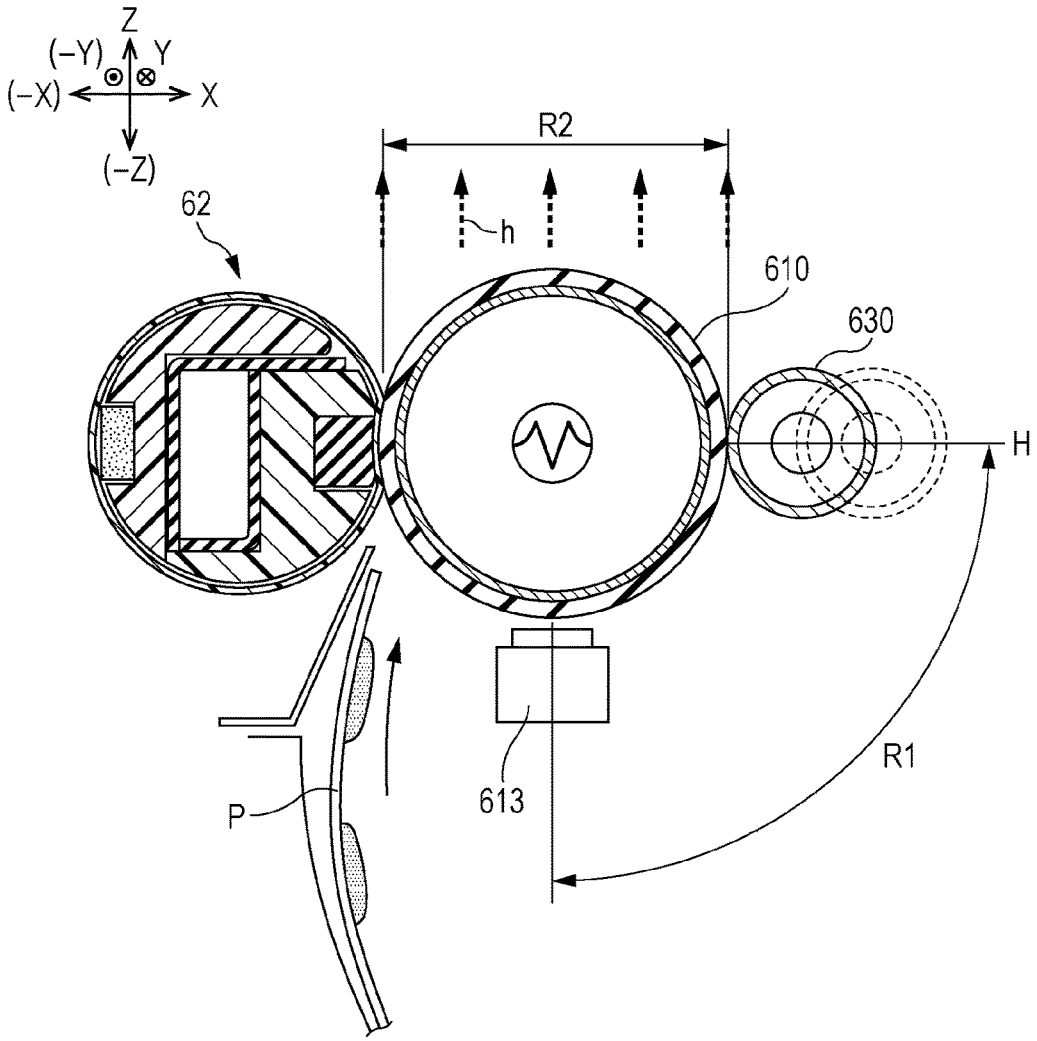
FIG. 3 is a schematic sectional view of the fixing device illustrating an arrangement of a heat absorbing roller and a thermostat.
Figure 4A:
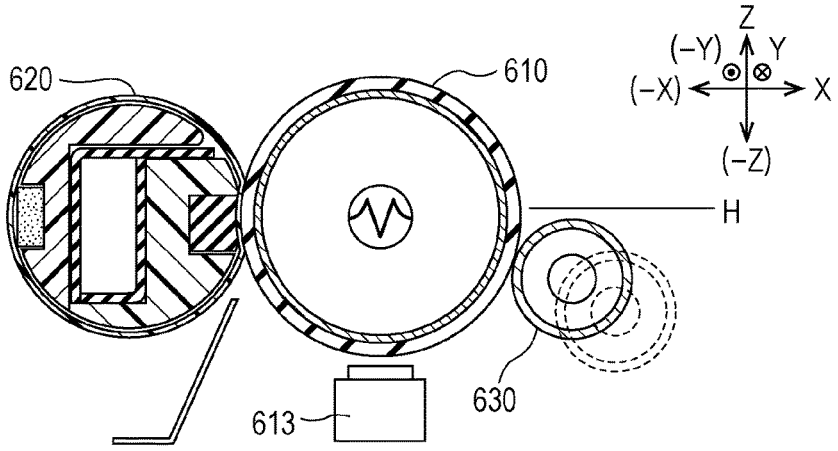
FIGS. 4A to 4C are schematic sectional views of the fixing device illustrating specific examples of arrangements of the heat absorbing roller and the thermostat.
Figure 4B:
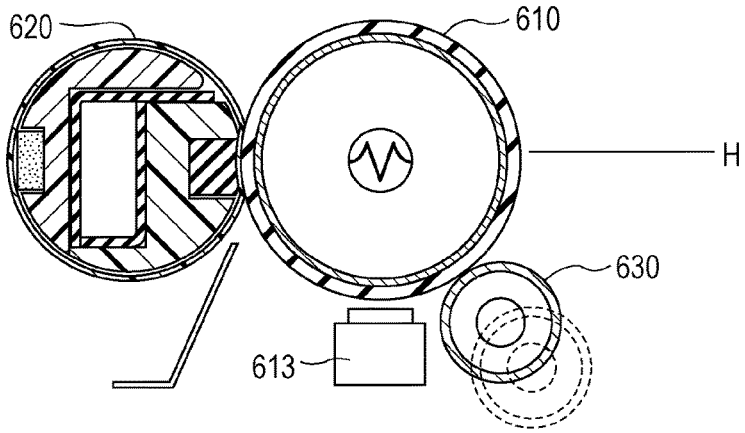
Figure 4C:
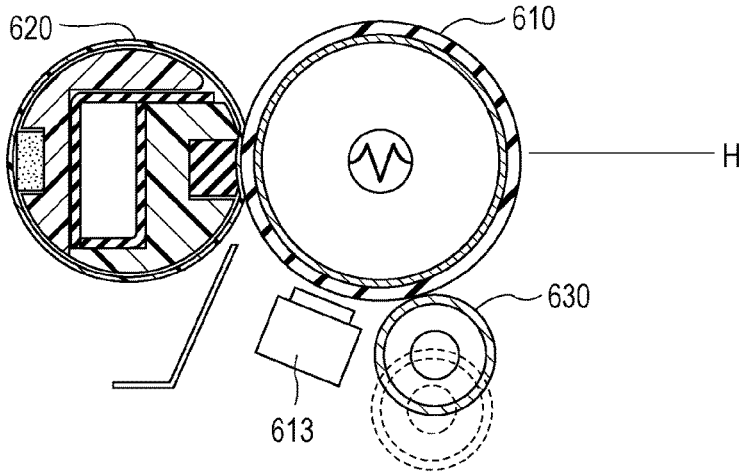
Figure 5A:
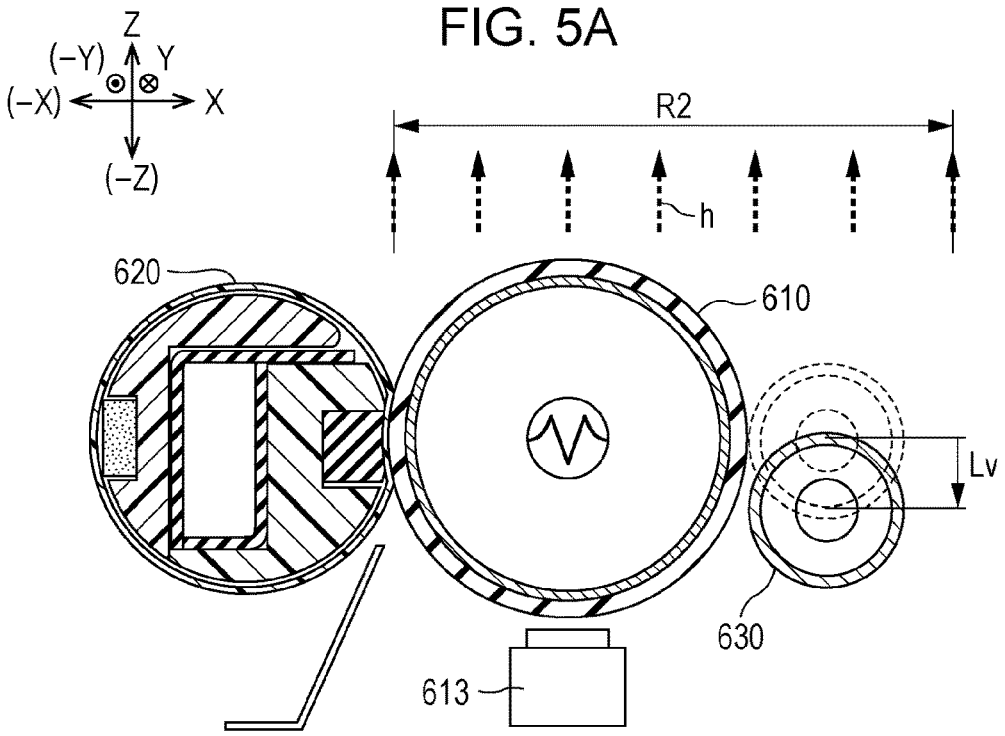
FIGS. 5A and 5B are schematic sectional views of the fixing device illustrating directions in which the heat absorbing roller is moved.
Figure 5B:
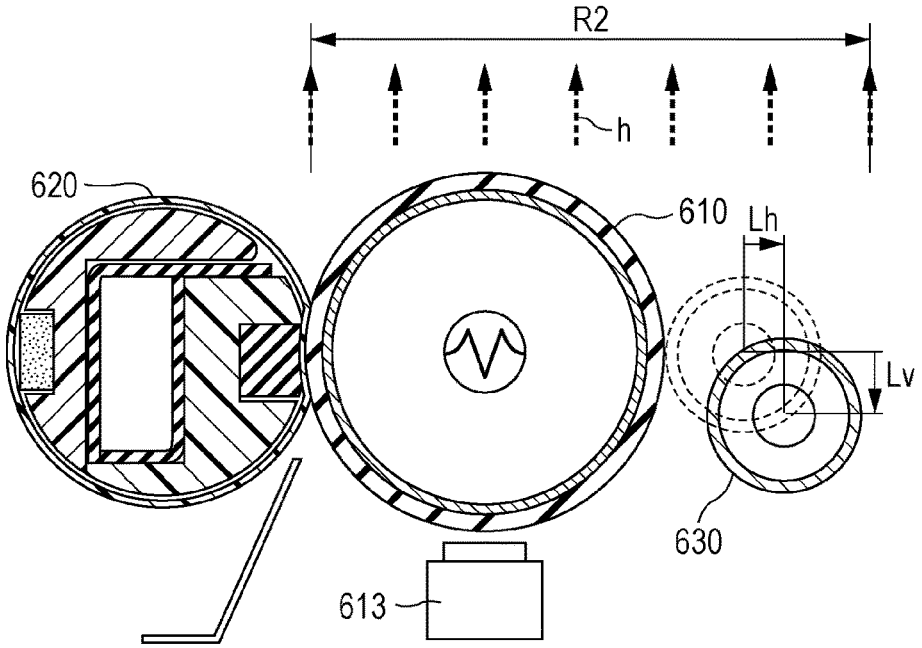
Figure 9:
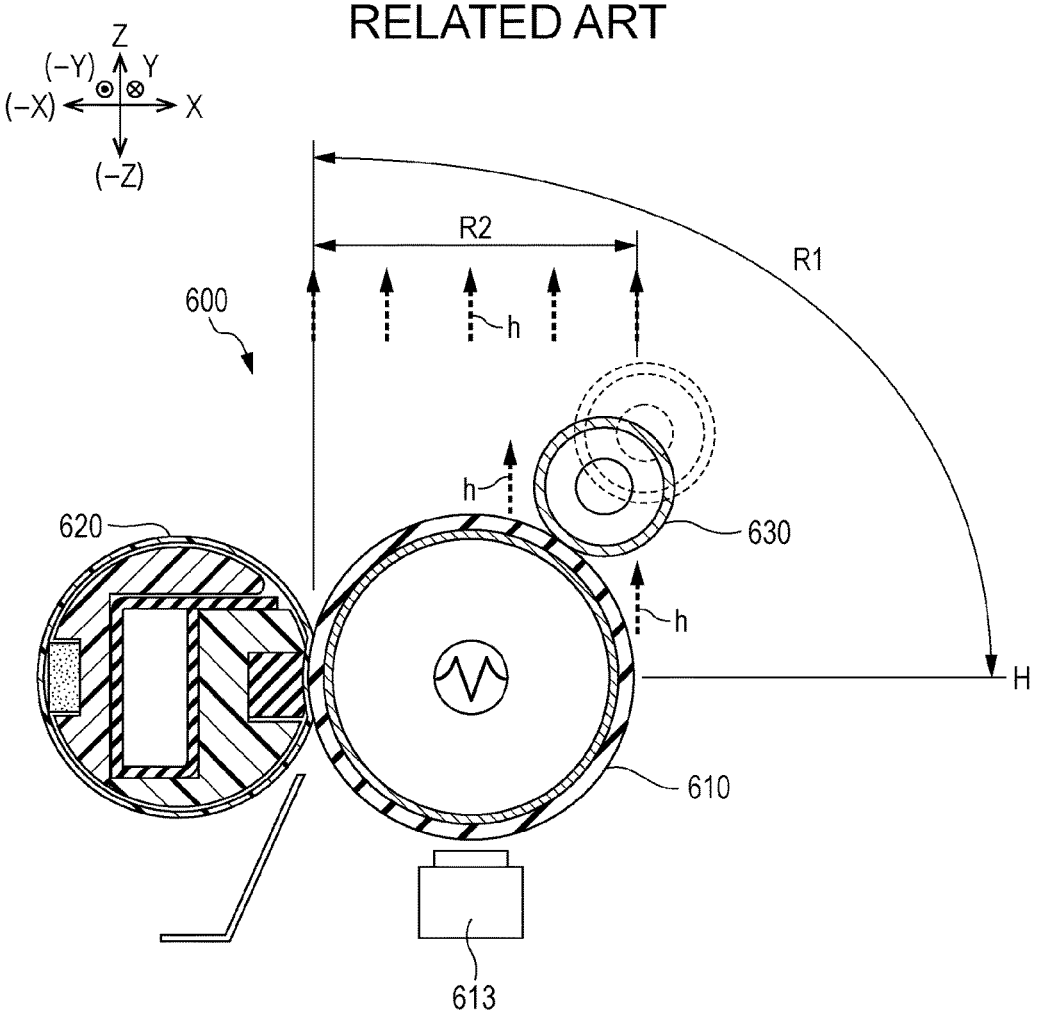
FIG. 9 RELATED ART
FIG. 9 is a schematic sectional view of a fixing device according to a comparative example illustrating an arrangement of a heat absorbing roller.

FIG. 3 is a schematic sectional view of the fixing device 60 illustrating the arrangement of the heat absorbing roller 630 and the thermostat 613 according to the present exemplary embodiment. FIGS. 4A to 4C are schematic sectional views of the fixing device 60 illustrating specific examples of arrangements of the heat absorbing roller 630 and the thermostat 613. FIGS. 5A and 5B are schematic sectional views of the fixing device 60 illustrating directions in which the heat absorbing roller 630 is moved. FIG. 9 is a schematic sectional view of a fixing device 600 according to a comparative example illustrating an arrangement of the heat absorbing roller 630.

Referring to FIG. 3, the heat absorbing roller 630 is disposed at a location (region R1 in FIG. 3) where the heat absorbing roller 630 does not overlap the region above the heating roller 610 in the vertical direction (Z direction: region R2 in FIG. 3) when in contact with the heating roller 610 and also does not overlap the region above the heating roller 610 in the vertical direction (Z direction) when separated from the heating roller 610 (as shown by the broken lines in FIG. 3).

According to the present exemplary embodiment, an excessive temperature increase of the heat absorbing roller 630 is less than that in a configuration in which the heat absorbing roller 630 that serves as contact means is disposed vertically above the heating roller 610 that serves as heating means.

An example of the present exemplary embodiment and a comparative example will now be described.

Comparative Example

FIG. 9 illustrates the fixing device 600 according to the comparative example in which the heat absorbing roller 630 overlaps the region R2 above the heating roller 610 in the vertical direction when in contact with the heating roller 610 and also overlaps the region R2 above the heating roller 610 in the vertical direction when separated from the heating roller 610.

As illustrated in FIG. 9, the heat absorbing roller 630 of the fixing device 600 is disposed at a location (region R1 in FIG. 9) where the heat absorbing roller 630 overlaps the region R2 above the heating roller 610 in the vertical direction. The heat absorbing roller 630 is movable between a position at which the heat absorbing roller 630 is in contact with the outer peripheral surface of the heating roller 610 and a position at which the heat absorbing roller 630 is separated from the outer peripheral surface of the heating roller 610.

Referring to FIG. 9, heat generated by the heating roller 610 of the fixing device 600 is radiated toward the region R2 above the heating roller 610 in the vertical direction (Z direction), as shown by arrows h in FIG. 9. As a result, the temperature of the heat absorbing roller 630 disposed in the region R2 vertically above the heating roller 610 is increased by the upwardly radiated heat, and the temperature difference between the heat absorbing roller 630 and the outer peripheral surface of the heating roller 610 is reduced. Thus, there is a risk that the ability to absorb heat from the excessively heated outer peripheral surface of the heating roller 610 will be reduced.

EXAMPLES

As illustrated in FIG. 1, the image forming apparatus 1 according to the present exemplary embodiment includes a C-shaped transport path along which the paper sheet P is transported from the sheet feeding device 20 to the transport rollers 69 via the second transfer roller 53. The heating module 61 and the pressing module 62 of the fixing device 60 face each other in a substantially horizontal direction (X direction), and the paper sheet P is transported through the fixing nip portion N in the vertical direction (Z direction).

In the fixing device 60 arranged as described above, the heat absorbing roller 630 is located in the region R1 illustrated in FIG. 3, where the heat absorbing roller 630 does not overlap the region R2 above the heating roller 610 in the vertical direction (region R2 in FIG. 3) when in contact with the heating roller 610 and also does not overlap the region R2 above the heating roller 610 in the vertical direction (region R2 in FIG. 3) when separated from the heating roller 610 (as shown by the broken lines in FIG. 3).

The thermistor (not shown) and the thermostat 613, which serve as temperature detectors, are located in the region R1 illustrated in FIG. 3 so that the thermistor and the thermostat 613 do not overlap the region R2 above the heating roller 610 in the vertical direction (region R2 in FIG. 3) and are upstream of the fixing nip portion N in the rotation direction of the heating roller 610.

FIGS. 4A, 4B, and 4C illustrate examples of specific arrangements of the heat absorbing roller 630 and the thermostat 613 in the fixing device 60.

In the fixing device 60 illustrated in FIG. 4A, the heat absorbing roller 630 is disposed below a horizontal line H, which passes through the center of the heating roller 610, in the −Z direction, and is moved away from the heating roller 610 downward in the direction of gravity.

Compared with the arrangement illustrated in FIG. 4A, in the fixing devices 60 illustrated in FIGS. 4B and 4C, the heat absorbing roller 630 is disposed further below the horizontal line H, which passes through the center of the heating roller 610, in the −Z direction, and is moved further downward away from the heating roller 610 in the direction of gravity.

As illustrated in FIG. 3, heat generated by the heating roller 610 is radiated toward the region R2 vertically above the heating roller 610 (region R2 in FIG. 3). Since the heat absorbing roller 630 is disposed below the horizontal line H, which passes through the center of the heating roller 610, in the −Z direction, the heat absorbing roller 630 is not easily influenced by the heat radiated vertically upward from the heating roller 610. As a result, unlike the configuration according to the comparative example in which the heat absorbing roller 630 overlaps the region R2 vertically above the heating roller 610, an excessive temperature increase of the heat absorbing roller 630 may be suppressed and the heat absorbing performance of the heat absorbing roller 630 may be maintained.

The thermistor and the thermostat 613 are also disposed below the horizontal line H, which passes through the center of the heating roller 610, in the −Z direction, and are therefore not easily influenced by the heat radiated vertically upward from the heating roller 610.

As illustrated in FIGS. 5A and 5B, the heat absorbing roller 630 is separated from the outer peripheral surface of the heating roller 610 by moving the heat absorbing roller 630 downward away from the heating roller 610 in the direction of gravity (−Z direction). For example, as illustrated in FIG. 5A, the heat absorbing roller 630 may be retracted from the position where the heat absorbing roller 630 is in contact with the outer peripheral surface of the heating roller 610 (as shown by the broken lines in FIG. 5A) by moving the heat absorbing roller 630 downward in the direction of gravity by Lv.

As conceptually indicated by arrows h in FIG. 5A, heat generated by the heating roller 610 is radiated toward the region R2 vertically above the heating roller 610 (region R2 in FIG. 5A). Since the heat absorbing roller 630 is moved downward in the direction of gravity, heat transfer from the heating roller 610 to the heat absorbing roller 630 may be reliably suppressed.

As illustrated in FIG. 5B, the heat absorbing roller 630 may be moved away from the outer peripheral surface of the heating roller 610 such that a distance (Lh) by which the heat absorbing roller 630 is moved in a horizontal direction perpendicular to the direction of gravity is greater than a distance (Lv) by which the heat absorbing roller 630 is moved downward in the direction of gravity. In this case, heat transfer from the heating roller 610 to the heat absorbing roller 630 may be more reliably suppressed.

Modifications

Figure 6:
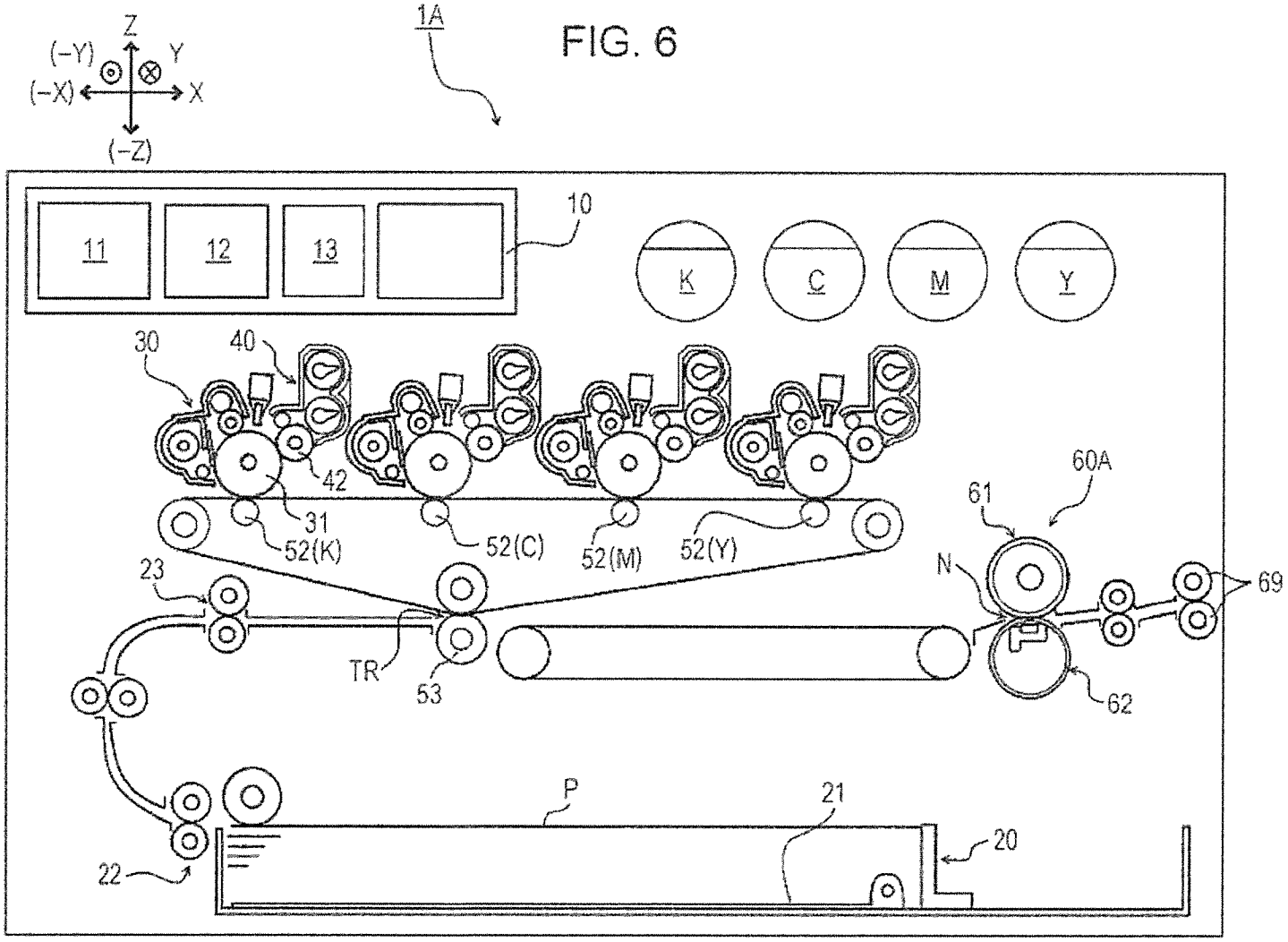
FIG. 6 is a schematic sectional view illustrating the internal structure of an image forming apparatus according to a modification.
Figure 7:
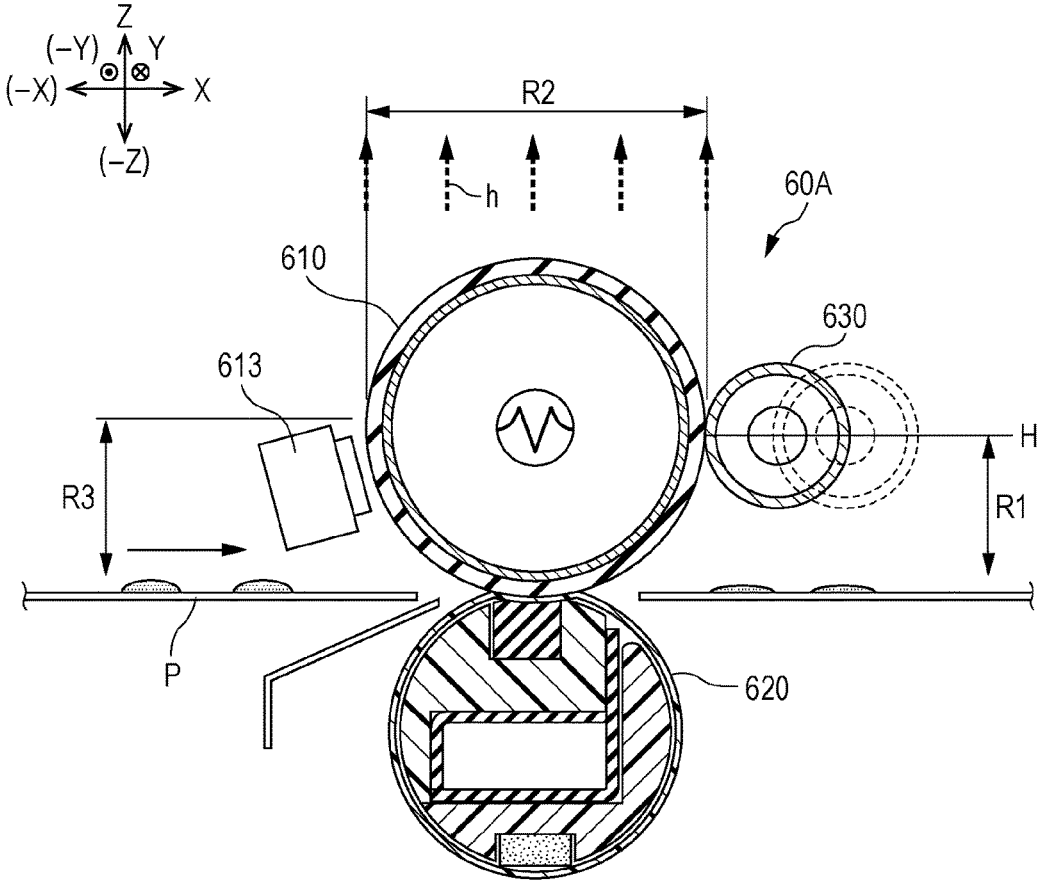
FIG. 7 is a schematic sectional view of a fixing device according to the modification.
Figure 8A:
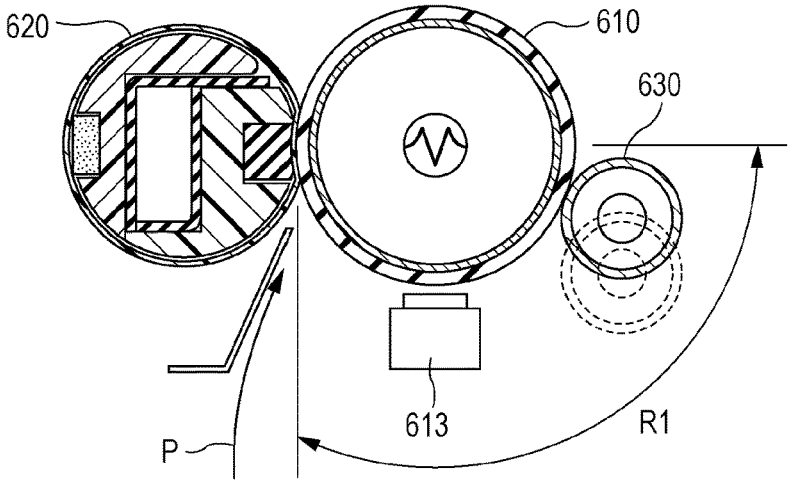
FIGS. 8A to 8C illustrate examples of arrangements of a fixing device on a C-shaped transport path.
Figure 8B:
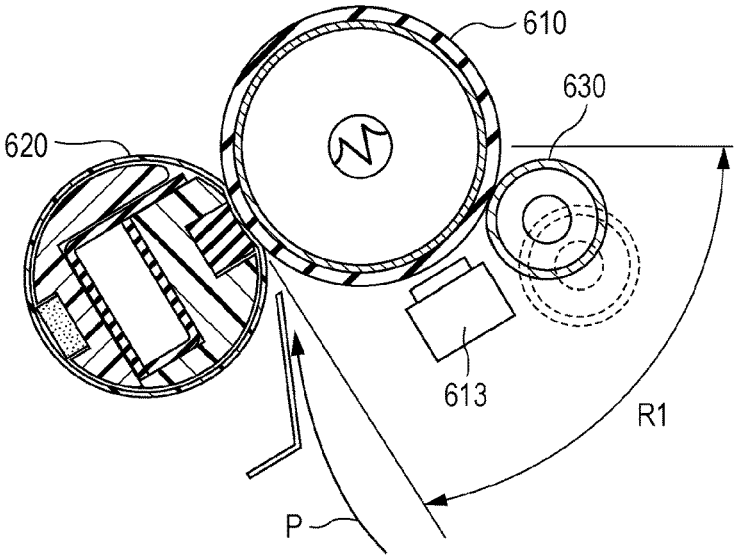
Figure 8C:
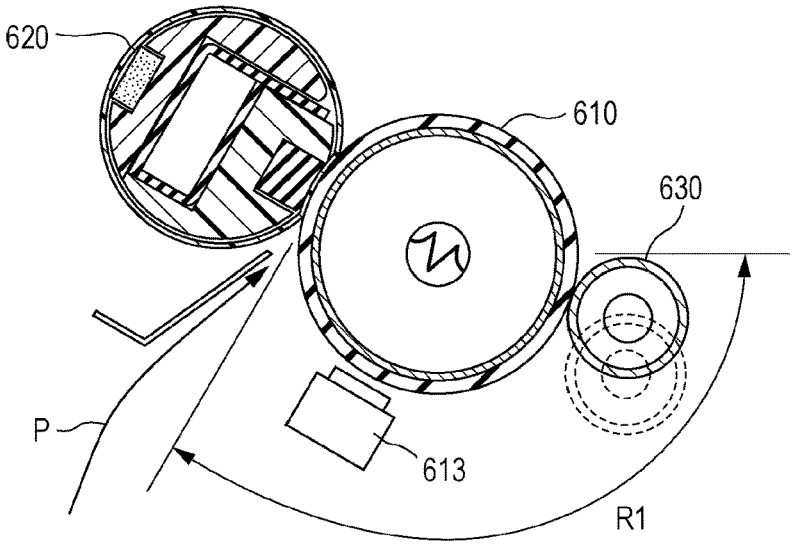

FIG. 6 is a schematic sectional view illustrating the internal structure of an image forming apparatus 1A according to a modification. FIG. 7 is a schematic sectional view of a fixing device 60A according to the modification. FIGS. 8A to 8C illustrate examples of arrangements of a fixing device on a C-shaped transport path.

The image forming apparatus 1A including the fixing device 60A according to the modification includes a horizontal transport path along which a paper sheet P is transported from a second transfer roller 53 to the fixing device 60A in a substantially horizontal direction. The fixing device 60A includes a heating module 61 and a pressing module 62 that face each other in a substantially vertical direction (Z direction), and the paper sheet P is transported through a fixing nip portion N in the horizontal direction (X direction).

A heat absorbing roller 630 is located in region R1 illustrated in FIG. 7, where the heat absorbing roller 630 does not overlap the region R2 above the heating roller 610 in the vertical direction (region R2 in FIG. 7) when in contact with the heating roller 610 and also does not overlap the region R2 above the heating roller 610 in the vertical direction (region R2 in FIG. 7) when separated from the heating roller 610 (as shown by the broken lines in FIG. 7).

As illustrated in FIG. 7, heat generated by the heating roller 610 is radiated toward the region R2 vertically above the heating roller 610 (region R2 in FIG. 7). Since the heat absorbing roller 630 is disposed below the horizontal line H, which passes through the center of the heating roller 610, in the −Z direction, the heat absorbing roller 630 is not easily influenced by the heat radiated vertically upward from the heating roller 610.

As a result, unlike the configuration according to the comparative example in which the heat absorbing roller 630 overlaps the region R2 vertically above the heating roller 610, an excessive temperature increase of the heat absorbing roller 630 may be suppressed and the heat absorbing performance of the heat absorbing roller 630 may be maintained.

In the fixing device 60A on the horizontal transport path, the region R1 that does not overlap the region R2 above the heating roller 610 in the vertical direction (region R1 in FIG. 7) is smaller than that in the fixing device 60 on the C-shaped transport path. In addition, the region R3 that is upstream of the fixing nip portion N and in which the thermistor (not shown) and the thermostat 613, which serve as temperature detectors, are disposed (region R3 in FIG. 7) is opposite the region R1 across the fixing nip portion N. Therefore, it is difficult to reduce the size of the fixing device 60A.

As illustrated in FIGS. 8A to 8C, in the fixing device 60 on the C-shaped transport path, the paper sheet P is transported to the fixing nip portion N along a path that extends in a substantially perpendicular direction (see arrow P in FIGS. 8A to 8C). Therefore, the region R1 that is upstream of the fixing nip portion N and that does not overlap the region R2 above the heating roller 610 in the vertical direction (region R1 in FIGS. 8A to 8C) is larger than that in the fixing device 60A on the horizontal transport path in FIG. 7.

Accordingly, a position at which the heat absorbing roller 630 does not overlap the region R2 above the heating roller 610 in the vertical direction when in contact with the heating roller 610 and also does not overlap the region R2 above the heating roller 610 in the vertical direction when separated from the heating roller 610 may be selected from a large area in the circumferential direction of the heating roller 610 (see R1 in FIGS. 8A to 8C).

As a result, the heat absorbing roller 630, the thermistor (not shown), and the thermostat 613 may be disposed next to each other in the circumferential direction of the heating roller 610 (see R1 in FIGS. 8A to 8C), and the size of the fixing device 60 may be reduced.

The arrangement in which the C-shaped transport extends in a "substantially perpendicular" direction includes not only the arrangement illustrated in FIG. 8A but also the arrangements illustrated in FIGS. 8B and 8C in which the inclination of the C-shaped transport path is small enough to achieve the above-described effects.

In the above-described present exemplary embodiment, the heating means is the heating roller 610 obtained by forming an elastic layer made of silicone rubber and a release layer containing fluorine resin on an outer peripheral surface of a thin-walled metal pipe that serves as a base material. However, the heating means is not limited to a heating roller, and may instead be a fixing belt. In this case, the pressing means may be a pressing roller obtained by forming a silicone rubber layer and a release layer on an outer peripheral surface of a metal core instead of the pressing belt.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a heating unit that is rotatable and includes a heat source;

a temperature detector that detects a temperature of the heating unit;

a pressing unit that is rotatable and forms a nip together with the heating unit; and a contact unit capable of coming into contact with and moving away from the heating unit, wherein the contact unit is positioned so that the contact unit does not overlap a region above the heating unit in a vertical direction when the contact unit is in contact with the heating unit and also does not overlap the region above the heating unit in the vertical direction when the contact unit is separated from the heating unit, and the temperature detector is positioned so that the temperature detector does not overlap a region above the contact unit in the vertical direction when the contact unit is in contact with the heating unit and also does not overlap the region above the contact unit in the vertical direction when the contact unit is separated from the heating unit.

2. The fixing device according to claim 1 wherein the temperature detector is positioned so that the temperature detector does not overlap the region above the heating unit in the vertical direction when the contact unit is in contact with the heating unit and also does not overlap the region above the heating unit in the vertical direction when the contact unit is separated from the heating unit.

3. The fixing device according to claim 2, wherein the contact unit moves downward away from the heating unit in a direction of gravity.

4. The fixing device according to claim 3, wherein a distance by which the contact unit moves away from an outer peripheral surface of the heating unit in a horizontal direction perpendicular to the direction of gravity is greater than a distance by which the contact unit moves downward away from the outer peripheral surface of the heating unit in the direction of gravity.

5. The fixing device according to claim 1, wherein the contact unit and the temperature detector are both disposed upstream of the nip in a rotation direction of the heating unit along a circumferential direction of the heating unit and below the heating unit in the vertical direction.

6. The fixing device according to claim 5, wherein the contact unit moves downward away from the heating unit in a direction of gravity.

7. The fixing device according to claim 6, wherein a distance by which the contact unit moves away from an outer peripheral surface of the heating unit in a horizontal direction orthogonal to the direction of gravity is greater than a distance by which the contact unit moves downward away from the outer peripheral surface of the heating unit in the direction of gravity.

8. The fixing device according to claim 1, wherein the contact unit moves downward away from the heating unit in a direction of gravity.

9. The fixing device according to claim 8, wherein a distance by which the contact unit moves away from an outer peripheral surface of the heating unit in a horizontal direction perpendicular to the direction of gravity is greater than a distance by which the contact unit moves downward away from the outer peripheral surface of the heating unit in the direction of gravity.

10. An image forming apparatus comprising:

an image forming unit that forms an image on a recording medium;

a sheet feeding unit that feeds the recording medium toward the image forming unit;

the fixing device according to claim 1 that fixes the image formed on the recording medium by the image forming unit to the recording medium; and a recording-medium-transporting unit that extends between the fixing device and the sheet feeding unit in a substantially perpendicular direction.

11. A fixing device comprising:

heating means that is rotatable and includes a heat source;

a temperature detector that detects a temperature of the heating means;

pressing means that is rotatable and forms a nip together with the heating means; and contact means capable of coming into contact with and moving away from the heating means, wherein the contact means is positioned so that the contact means does not overlap a region above the heating means in a vertical direction when the contact means is in contact with the heating means and also does not overlap the region above the heating means in the vertical direction when the contact means is separated from the heating means, and the temperature detector is positioned so that the temperature detector does not overlap a region above the contact means in the vertical direction when the contact means is in contact with the heating means and also does not overlap the region above the contact means in the vertical direction when the contact means is separated from the heating means.

* * * * *